US010284988B2

(12) United States Patent
Kraft et al.

(10) Patent No.: US 10,284,988 B2
(45) Date of Patent: May 7, 2019

(54) METHOD FOR ANALYSING AND DECOMPOSING STEREO AUDIO SIGNALS

(71) Applicants: Helmut-Schmidt-Universitat, Hamburg (DE); Hamburg Innovation GmbH, Hamburg (DE)

(72) Inventors: Sebastian Kraft, Hamburg (DE); Marco Fink, Hamburg (DE); Martin Mieth, Leipzig (DE); Udo Zolzer, Neu Wulmstorf (DE)

( * ) Notice: Subject to any disclaimer, the term of this patent is extended or adjusted under 35 U.S.C. 154(b) by 0 days.

(21) Appl. No.: 15/562,151

(22) PCT Filed: Mar. 21, 2016

(86) PCT No.: PCT/EP2016/056163

§ 371 (c)(1),
(2) Date: Sep. 27, 2017

(87) PCT Pub. No.: WO2016/156091

PCT Pub. Date: Oct. 6, 2016

(65) Prior Publication Data

US 2018/0084360 A1 Mar. 22, 2018

(30) Foreign Application Priority Data

Mar. 27, 2015 (DE) ..... 10 2015 104 699

(51) Int. Cl.
*H04S 3/00* (2006.01)
*H04S 3/02* (2006.01)
*H04S 5/00* (2006.01)

(52) U.S. Cl.
CPC ..... *H04S 3/008* (2013.01); *H04S 5/005* (2013.01); *H04S 3/02* (2013.01); *H04S 2400/05* (2013.01);

(Continued)

(58) Field of Classification Search
CPC ... G10L 19/008; G10L 19/0204; G10L 19/22; H04S 2400/01; H04S 3/02;

(Continued)

(56) References Cited

U.S. PATENT DOCUMENTS 5,594,800 A * 1/1997 Gerzon ..... H04S 3/02 381/18
7,257,231 B1 * 8/2007 Avendano ..... H04S 1/007 381/99

(Continued)

FOREIGN PATENT DOCUMENTS

DE 10 2012 017296 B4 7/2014
WO 2010028784 A1 3/2010

OTHER PUBLICATIONS

Lee et al., "Virtual 5.1 Channel Reproduction of Stereo Sound for Mobile Devices", AES Convention 132; Apr. 2012, AES, 60 East 42nd Street, Room 2520, New York 10165-2520, USA, Apr. 26, 2012, XP040574620, Audio Engineering Society, convention paper 8656; 8 pages.

(Continued)

*Primary Examiner* — Alexander Jamal
(74) *Attorney, Agent, or Firm* — Jack M. Cook; Quarles & Brady LLP

(57) ABSTRACT

A method for analysing and decomposing a stereo audio signal including an audio signal for a left reproduction device and an audio signal for a right reproduction device by extracting panning coefficients that contain direction information about the sound sources from which the stereo audio signal originates based on the approximation that one sound source can be regarded as dominant for each frequency. This approximation allows the panning coefficients to be obtained, by solving a system of equations, with lower computation complexity than in the prior art. The sound quality that is obtained after re-panning the signal enhanced in this manner for a configuration with more than two loudspeakers is constant or better. Advantageously, following determination of the panning coefficients, the direct signal and two ambient signals that are not correlated with the direct sound source are extracted from the stereo audio signal.

17 Claims, 5 Drawing Sheets

Figure 1:
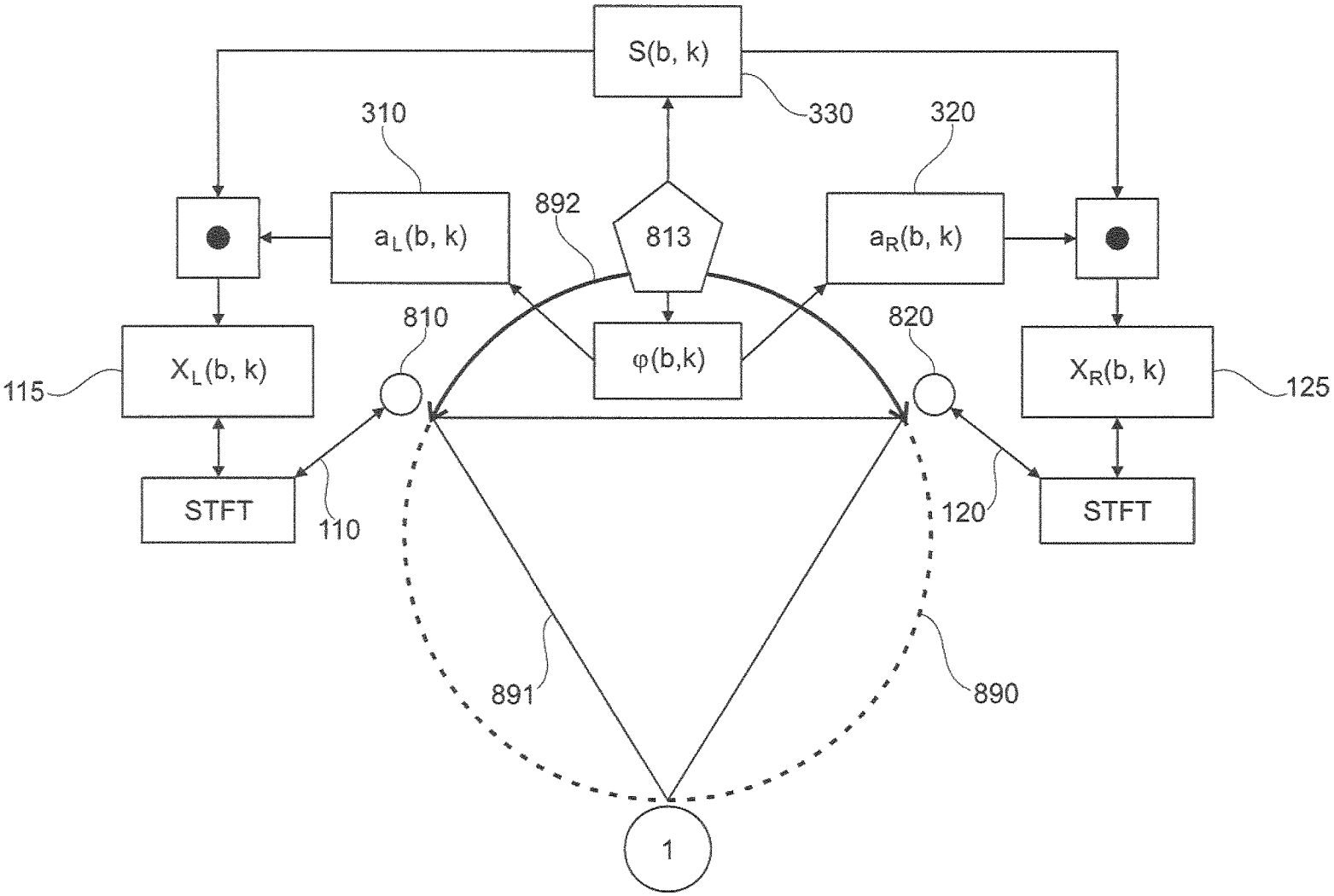

(52) U.S. Cl.
CPC ..... *H04S 2400/11* (2013.01); *H04S 2420/07* (2013.01)

(58) Field of Classification Search
CPC ..... H04S 2400/11; H04S 2420/11; H04S 2420/01; H04S 7/30; H04S 5/005; H04S 7/304; H04S 1/007
USPC ..... 381/310, 22, 99, 300
See application file for complete search history.

(56) References Cited

U.S. PATENT DOCUMENTS

| | | | | |
|---|---|---|---|---|
| 2009/0252338 | A1* | 10/2009 | Koppens ..... | H04S 7/00 381/17 |
| 2011/0116638 | A1 | 5/2011 | Son et al. | |
| 2013/0170649 | A1 | 7/2013 | Lee | |

OTHER PUBLICATIONS

Goodwin et al., "Primary-Ambient Signal Decomposition and Vector-Based Localization for Spatial Audi Coding and Enhancement", 2007 IEEE International Conference on Acoustics, Speech, and Signal Processing; Apr. 15-20, 2007, Honolulu, HI, USA; Apr. 15, 2007, XP031462785, 9 pages.

English Translation of International Search Report and Written Opinion for PCT/EP2015/056163, dated Jun. 10, 2016, 10 pages.

* cited by examiner

METHOD FOR ANALYSING AND DECOMPOSING STEREO AUDIO SIGNALS

CROSS-REFERENCE TO RELATED APPLICATIONS

This application represents the national stage entry of PCT International Application PCT/EP2016/056163 filed Mar. 21, 2016, which claims priority to German Patent Application DE 10 2015 104 699.7 filed on Mar. 27, 2015. The contents of these applications are hereby incorporated by reference as if set forth in their entirety herein.

The invention relates to a method for analysing and decomposing a stereo audio signal and to a method for generating a multichannel audio signal.

PRIOR ART

When a stereo audio signal is recorded, a first audio signal generally being used for a left reproduction device and a second audio signal for a right reproduction device, the impression can be created that phantom sound sources are distributed over a listening region between the listener and the two reproduction devices.

In this context, the level difference between the first and the second audio signal primarily supplies the information as to the azimuthal direction relative to the listener from which the sound seems to come. This information is merely one-dimensional, and therefore by its nature cannot establish a realistic reproduction of three-dimensionality. In addition, the azimuth angle of the possible positioning of phantom sound sources is limited to the region spanned by a first connecting line between the listener and the left reproduction device and a second connecting line between the listener and the right reproduction device. Further, with only two reproduction devices it is not possible to simulate three-dimensionality, since for this purpose the sound would have to be emitted and reach the listener from all spatial directions.

Multichannel audio systems comprising for example five or seven reproduction devices therefore give the listener a much more detailed three-dimensional impression. However, this additional utility is basically wasted if the recording is only available as a stereo audio signal.

DE 10 2012 017 296 B4 discloses a method for generating a multichannel audio signal from a stereo audio signal. Thus, directional direct sound components and diffuse ambient sound components in a stereo audio signal can be split, and the direction information of the direct sound components can be determined, so as subsequently to play back all signal components on a multichannel reproduction device. However, this method is very computationally intensive.

OBJECT AND SOLUTION

Therefore, an object of the present invention is to reconstruct the three-dimensional information contained in a stereo audio signal as to the arrangement of the sound sources at a reduced computing time with unchanged or improved sound quality.

This object is achieved according to the invention by analysis methods according to the main claim and a coordinated claim and by a method for generating a multichannel audio signal according to a further coordinated claim. Further advantageous embodiments may be derived from the dependent claims dependent thereon.

SUBJECT MATTER OF THE INVENTION

In the context of the invention, a method for analysing and decomposing a stereo audio signal has been developed. This stereo audio signal comprises a first audio signal for a left reproduction device and a second audio signal for a right reproduction device.

According to the invention, the method provides the following steps:

Initially, the first audio signal is converted into a first time-frequency representation. The second audio signal is converted into a second time-frequency representation. The audio signals can be converted into the time-frequency representation by any desired methods. Preferably, the short-time Fourier transform (STFT) is used.

Subsequently, a first equation is established relating the first time-frequency representation to the product of a first time- and frequency-dependent panning coefficient with the time- and frequency-dependent signal of a direct sound source arranged in a listening region between the left reproduction device and the right reproduction device. A second equation is established relating the second time-frequency representation to the product of a second time- and frequency-dependent panning coefficient with the same signal of the direct sound source. The panning coefficients are configured so as to position the direct sound source in the listening region.

The panning coefficients, and/or a position coefficient which corresponds to the difference between the squares of the panning coefficients, are now determined as solutions to the equation system formed from the two equations. In general, a multiplicity of independent sound sources have contributed to the stereo audio signal. The component of the first and the second audio signal accessible to directional hearing is thus composed of the contributions of these individual sound sources. Each of these individual contributions is the product of a time- and frequency-dependent complex amplitude with a panning coefficient, wherein the panning coefficient is dependent on the positioning of the sound source relative to the listener. Ignoring ambient signals in each case, the left and the right audio signal are each a sum of individual contributions of this type. Since the ambient signal is diffuse and uniformly distributed over all spatial directions, and is also small by comparison with the direct signal, it can be neglected in the equation system for determining the panning coefficients. The equation system is thus much simpler to solve.

In establishing the equation system, the simplifying assumption is made that all simultaneously active sound sources can be combined into one single sound source having a time- and frequency-dependent complex amplitude. This is possible because, for a sufficiently high time-frequency resolution of the time-frequency representation, it can be assumed that there is only a single dominant sound source in a particular frequency band at a particular point in time.

In this context, the complex amplitude of this combined sound source is independent of direction. The directional dependency is only present in the panning coefficients. As a result of the individual sound sources being combined, the first and the second panning coefficient of each sound source can now be united to form a pair of time- and frequency-dependent panning coefficients for the combined sound source.

Under the assumption that the first and the second panning coefficient are linked to one another, the equation system can be mathematically rearranged, and the panning coefficients can be determined from the first and second channel of the stereo signal. The link between the two panning coefficients makes it possible to solve the equation system by simple mathematical rearrangement and to specify a closed formula for the panning coefficients in the time-frequency representations of the left and the right audio signal.

During operation of the method, solutions to the equation system can thus be obtained particularly rapidly by plugging the time-frequency representations into the closed formula.

In a particularly advantageous embodiment of the invention, the equation system is solved with the additional condition that the sum of the squares of the panning coefficients is constant. In the constant power panning usually used in music production, the sum of these squares is equal to 1. This means that the sound source is perceived as being equally loud irrespective of the position thereof in the listening region.

The panning coefficients contain the complete information as to the frequency at which, the time at which and the location in the listening region from which the signal seems to come.

Since the individual sound sources are superposed incoherently and the stereo audio signal is also recorded incoherently, a different positioning of the sound sources in the listening region merely alters the amplitude of the recorded stereo audio signal, and not the phase thereof. Therefore, the time-frequency representations of the first and second audio signals are also in phase with the time- and frequency-dependent complex amplitudes of the direct sound source. The phase terms from the described equation system thus cancel each other out, and after rearrangement the first panning coefficient is given by the root of the ratio of the square of the magnitude of the time-frequency representation of the first audio signal (numerator) to the sum of the squares of the magnitudes of the time-frequency representations of the first and second audio signals (denominator). Analogously, the second panning coefficient is given by the root of the ratio of the square of the magnitude of the time-frequency representation of the second audio signal (numerator) to the sum of the squares of the magnitudes of the time-frequency representations of the first and second audio signals (denominator).

The position coefficient can be determined from the ratio of the difference between the squares of the magnitudes of the two time-frequency representations to the sum of the squares of the magnitudes of the two time-frequency representations.

An alternative embodiment of the invention likewise starts from a first audio signal for a left reproduction device and a second audio signal for a right reproduction device. The first audio signal is converted into a first time-frequency representation and the second audio signal is converted into a second time-frequency representation.

In this embodiment, the time- and frequency-dependent power of the first audio signal is determined from the first time-frequency representation, and the time- and frequency-dependent power of the second audio signal is determined from the second time-frequency representation. The equations for the panning coefficients are also modified accordingly.

A first equation is established relating the time- and frequency-dependent power of the first audio signal to the product of the square of a first time- and frequency-dependent panning coefficient with the time- and frequency-dependent power of a direct sound source arranged in a listening region between the left reproduction device and the right reproduction device.

A second equation is established relating the time- and frequency-dependent power of the second audio signal to the product of the square of a second time- and frequency-dependent panning coefficient with the same time- and frequency-dependent power of the same direct sound source.

Analogously to the above-described first approach for the equation system, in which the equations link the time-frequency representations to the signal of the direct sound source, the panning coefficients are configured so as to position the direct sound source in the listening region. The panning coefficients and/or a position coefficient, which corresponds to the ratio of a difference between the panning coefficients to the sum of the panning coefficients, are determined as solutions to the equation system formed from the two equations.

The motivation for establishing the equation system using powers, and not directly using time-frequency representations and the signal of the direct sound source, is that the panning is pure amplitude panning. Therefore, both audio signals are in phase with the signal of the direct sound source. If the time-frequency representations have been obtained for example using a short-time Fourier transform (STFT), a power can be expressed directly as a square of the magnitude of the associated power density spectrum. The approach using the powers is then equivalent to the approach using the time-frequency representations and the signal of the direct sound source.

However, the approach using the powers has the additional advantage that it is more general. It is applicable even if there is no 1:1 transformation of the time-dependent audio signals into a frequency region and these audio signals are instead merely split into a plurality of time-dependent signals which correspond to the contributions of particular frequency bands. Splitting of this type can be provided for example using a filter bank. A filter bank typically contains a plurality of band-pass filters connected in parallel, each of which allows the component of the signal within a particular frequency band to pass through. The signal at the output of each of these band-pass filters is a time-dependent signal. The totality of all these signals, together with the information as to the frequency band to which each signal corresponds, forms a time-frequency representation.

On the one hand, a time-frequency representation of this type can be obtained more rapidly and simply in this manner than using the short-time Fourier transform (STFT). For example, low-order band-pass filters having a low group delay can be used. On the other hand, a time-frequency representation of this type also simplifies the frequency-dependent processing of the signal. For example, the frequency resolution can be varied in that a frequency range of lesser interest is covered using a wide band-pass filter, whilst a frequency range of particular interest is covered using multiple narrow band-pass filters. By contrast, for the short-time Fourier transform, the frequency resolution is always an equidistant pattern.

It is not necessary for a closed formula to exist for calculating each time- and frequency-dependent power from the time-frequency representations of the two audio signals. For example, it is also possible to determine this power approximately by numerical methods. For example, the time- and frequency-dependent power of at least one audio signal at a time of interest can be determined as a weighted sum of the time- and frequency-dependent power of the audio signal at an earlier time and the square of the time-frequency representation of this audio signal at the time of interest. If the time in the time-frequency representation is discretised, for example, the earlier time may in particular be one discrete time unit before the time of interest. The instantaneous power of an audio signal can thus for example be determined from the time-frequency representation by recursive averaging.

Advantageously, the equation system is solved under the additional condition that the sum of the squares of the panning coefficients is constant.

The equation system for the panning coefficients is solved completely analogously to the approach using the time-frequency representations and the signal of the direct sound source. The panning coefficients, and if applicable the position coefficient, are merely expressed using different quantities.

Advantageously, the first panning coefficient is therefore determined as the root of the ratio of the time- and frequency-dependent power of the first audio signal to the sum of the time- and frequency-dependent powers of the two audio signals. The second panning coefficient is accordingly determined as the root of the ratio of the time- and frequency-dependent power of the second audio signal to the sum of the time- and frequency-dependent powers of the two audio signals.

Advantageously, the time- and frequency-dependent power of at least one audio signal at a time of interest is determined as a weighted sum of the time- and frequency-dependent power of the audio signal at an earlier time and the square of the time-frequency representation of this audio signal at the time of interest.

In general, the stereo audio signal will not contain just one direction-dependent direct signal component. Instead, the first and the second audio signal will each be superimposed with a diffuse ambient signal. Therefore, in a further particularly advantageous embodiment of the invention, the signal of the direct sound source (direct signal) and/or two ambient signals which are not direction-dependent, in other words not correlated with the direct sound source, are determined from the panning coefficients. In this context, the first ambient signal is merely contained in the time-frequency representation of the first audio signal, and the second ambient signal is merely contained in the time-frequency representation of the second audio signal. The listening experience is reproduced more exactly if only the direct signal is reproduced in directed form using the panning coefficients. The diffuse ambient signal should also be reproduced diffusely.

Advantageously, the direct signal and the ambient signals are determined by an iterative method, on the basis of an iteration instruction which relates the direct signal of each iteration, and/or a contribution to this signal, to the ambient signals of the previous iteration. For example, at each iteration the volume of a contribution to the direct signal can be set as the arithmetic mean of the volumes of the two ambient signals of the previous iteration. This is based on the assumption that the direct signal is present in the same phase in the first and second audio signals and the ambient signals are phase-shifted therefrom.

The approximation can be refined in that at each iteration, the panning coefficients are recalculated from the ambient signals of the previous iteration. For this purpose, for example, the ambient signals of the previous iteration may be evaluated as time-frequency representations of a left and a right audio signal, in such a way that the panning coefficients can, as before, be described by solving an equation system.

Advantageously, in this case the first ambient signal is corrected at each iteration by an amount equal to the product of the recalculated first panning coefficient with the direct signal or with the signal contribution according to the current iteration. Analogously, the second ambient signal is corrected at each iteration by an amount equal to the product of the recalculated second panning coefficient with the direct signal or with the signal contribution according to the current iteration. The idea behind this is that the solution should be internally consistent: a signal which is retrospectively found to correlate with the signal of the direct sound source and thus to be part of the direct signal obviously cannot count towards the diffuse ambient signal.

After all iterations are complete, the complete direct signal is given by the sum of the signal contributions determined in all of the individual iterations. Since the iteratively calculated panning coefficients and the iteratively determined direct signal are each merely an estimate, it is not guaranteed that the sum of the direct signal weighted using the first panning coefficient and the first ambient signal exactly corresponds to the value of the time-frequency representation of the first audio signal. Analogously, it cannot be guaranteed that the sum of the direct signal weighted using the second panning coefficient and the second ambient signal exactly reproduces the value of the time-frequency representation of the second audio signal. The direct signal and the ambient signals thus do not necessarily together adhere to the signal model used as a basis for dividing the time-frequency representations of each of the first and the second audio signal into a directed and a diffuse component. Therefore, it is advantageous not to reuse the ambient signals determined in the last iteration directly, but instead to determine the first ambient signal as the difference between the first time-frequency representation and the direct signal weighted using the first panning coefficient according to the first iteration. Analogously, the second ambient signal should be determined as the difference between the second time-frequency representation and the direct signal weighted using the second panning coefficient according to the first iteration.

A further advantageous approach for determining the ambient signals which are not correlated with the direct sound source is based on the assumption that the two ambient signals do sound similar but are decorrelated as a result of different propagation paths and reflections.

A first equation is established which relates the first time-frequency representation to the sum of the product of the first panning coefficient with the time- and frequency-dependent signal of the direct sound source and the filtering of a single shared ambient signal using a first decorrelation function.

A second equation is established which relates the second time-frequency representation to the sum of the product of the second panning coefficient with the time- and frequency-dependent signal of the direct sound source and the filtering of the shared ambient signal using a second decorrelation function.

A signal can be filtered using a decorrelation function by convolution of the signal with the decorrelation function, for example.

The time- and frequency-dependent signal of the direct sound source and/or the shared ambient signal are determined as solutions to the equation system formed from the two equations.

The decorrelation functions can be initialised using various methods known in the art so as to obtain realisticsounding decorrelated signals. Typically, for this purpose the functions are generated in such a way that random frequency characteristics occur.

In a time-frequency representation, filtering, and in this case in particular convolution, can be expressed approximately as frequency-band-wise multiplication with the decorrelation function. In this context, the decorrelation function may for example be represented by an amplification factor and a phase rotation for each frequency band.

Advantageously, the time- and frequency-dependent signal of the direct sound source is thus determined as the difference between the frequency-band-wise product of the first time-frequency representation with the second decorrelation function and the frequency-band-wise product of the second time-frequency representation with the first decorrelation function, divided by the difference between the frequency-band-wise product of the first panning coefficient with the second decorrelation function and the frequency-band-wise product of the second panning coefficient with the first decorrelation function.

Thus, advantageously, the shared ambient signal is determined as the difference between the product of the second time-frequency representation with the first panning coefficient and the product of the first time-frequency representation with the second panning coefficient, divided by the difference between the frequency-band-wise product of the first panning coefficient with the second decorrelation function and the frequency-band-wise product of the second panning coefficient with the first decorrelation function.

In the context of the invention, a method for generating a multichannel audio signal from a stereo audio signal has also been developed. In this context, the stereo audio signal has a first audio signal for a left reproduction device and a second audio signal for a right reproduction device.

According to the invention, the stereo audio signal is initially analysed by a method according to the invention. Subsequently, a plurality of repanning coefficients are determined from the panning coefficients, each of these repanning coefficients being assigned to one sound channel of a plurality of sound channels of the multichannel audio signal. In this context, the repanning coefficients for the plurality of sound channels are configured to position a direct sound source in a listening region between a plurality of reproduction devices for the multichannel audio signal. The signal of the direct sound source (direct signal) now has the first repanning coefficient applied and is assigned to a first sound channel. It has a second repanning coefficient applied and is assigned to a second sound channel. Finally, it also has a third repanning coefficient applied and is assigned to a third sound channel. These signals of these three sound channels may either be reproduced directly or be stored for subsequent reproduction or further processing.

Advantageously, the first ambient signal is added to the first sound channel and the second ambient signal is added to the third sound channel.

In a further advantageous embodiment of the invention, each sound channel is converted into an associated reproduction signal of the multichannel audio signal, each reproduction signal being destined for an associated reproduction device.

Determining the repanning coefficients constitutes a redistribution of the direction-dependent direct signal onto an arbitrary loudspeaker arrangement. The ambient signal is subsequently additively superposed on a selection of loudspeakers. For the repanning, any desired prior art method may be used, for example the method according to DE 10 2012 017 296 B4 or else vector base amplitude panning according to Ville Pulkki, "Virtual sound source positioning using vector base amplitude panning", Journal of the Audio Engineering Society, Vol. 45, Issue 6, pp. 456-466, June 1997.

In a further advantageous embodiment of the invention, the extracted direct and ambient sound signals can be used not just for immediate reproduction of the stereo audio signal as an enhanced multichannel audio signal. For example, they can be stored for subsequent reproduction, and/or manipulated prior to the reproduction so as to enhance the listening experience with further effects.

It has been found that, in the above-described iterative calculation of the direct signal and the ambient signals, as the number of iterations tends to infinity, the two ambient signals tend to values of equal magnitude and different signs. They are thus identical except for a phase factor. Using this additional simplification, this direct signal and the ambient signals can be obtained directly during operation with very little computing time.

Thus, in a further particularly advantageous embodiment of the invention, the signal of the direct sound source (direct signal) is determined from the ratio of the sum of the two time-frequency representations of the audio signals (numerator) to the sum of the two panning coefficients (denominator). Further, the ambient signals can also be obtained from the ratio of a difference between the time-frequency representation of the first audio signal, weighted using the second panning coefficient, and the time-frequency representation of the second audio signal, weighted using the first panning coefficient (numerator), to the sum of the two panning coefficients (denominator).

SPECIAL PART OF THE DESCRIPTION

Figure 2:
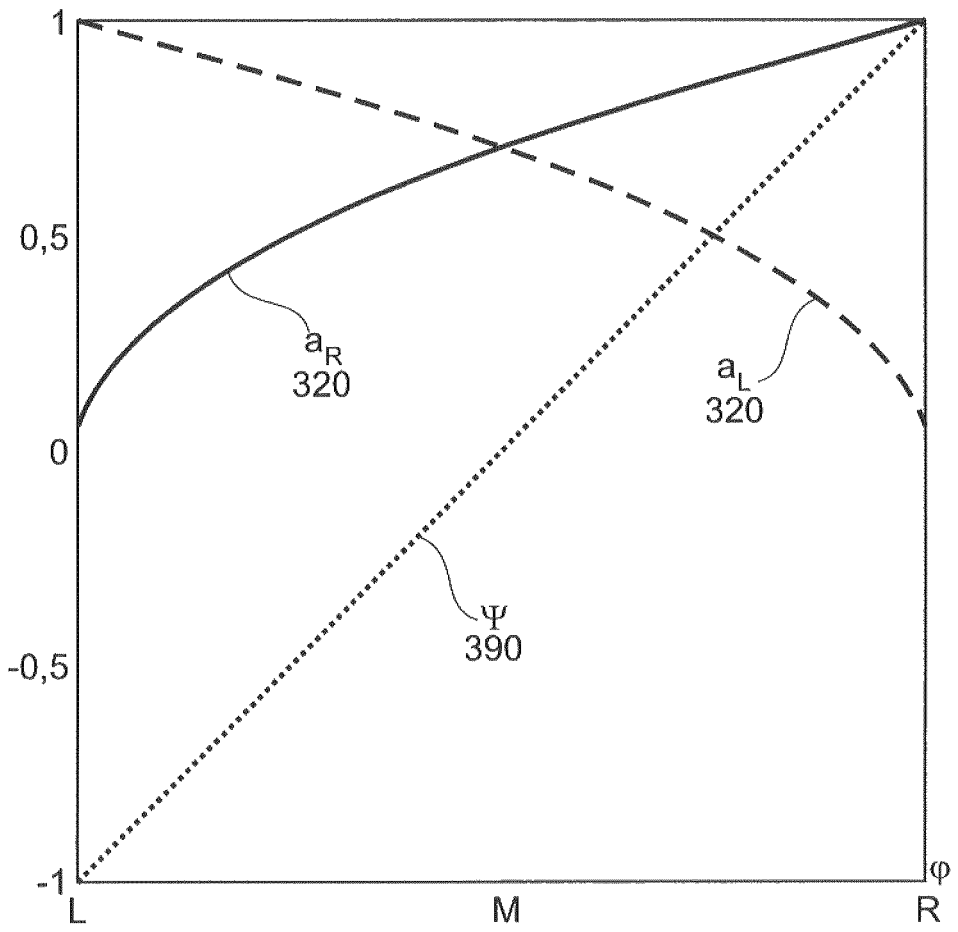
Figure 3:
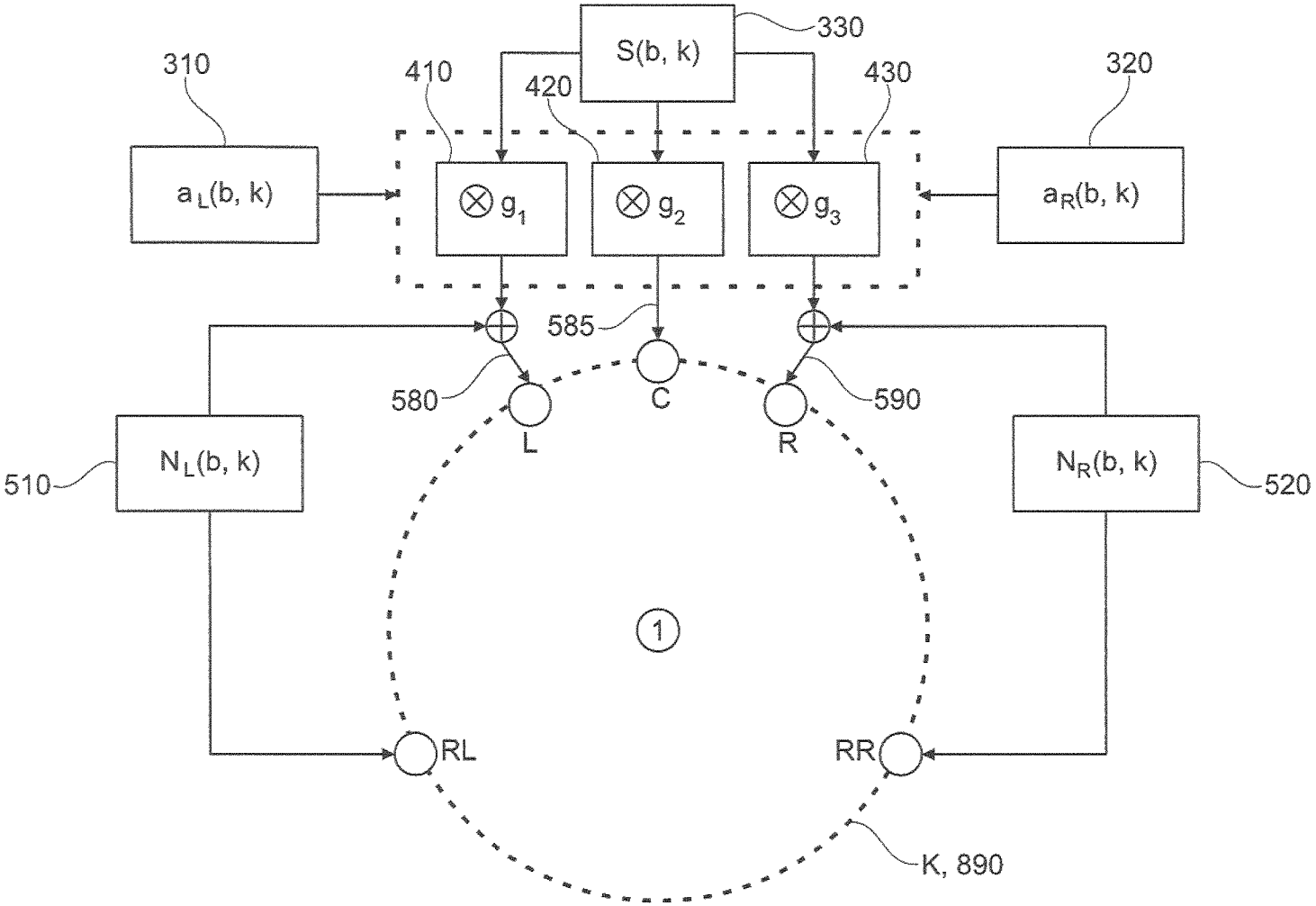
Figure 4:
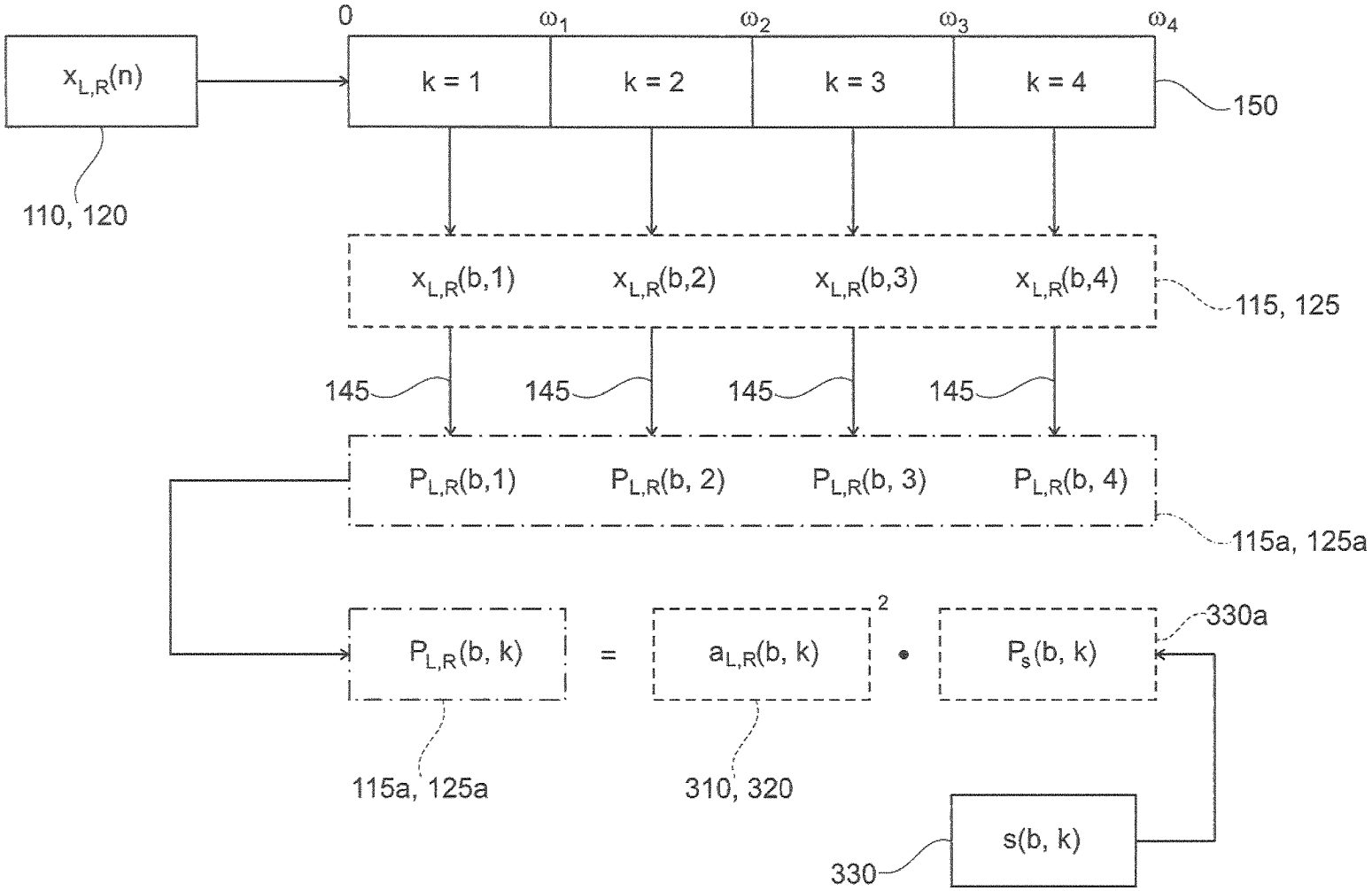
Figure 5:
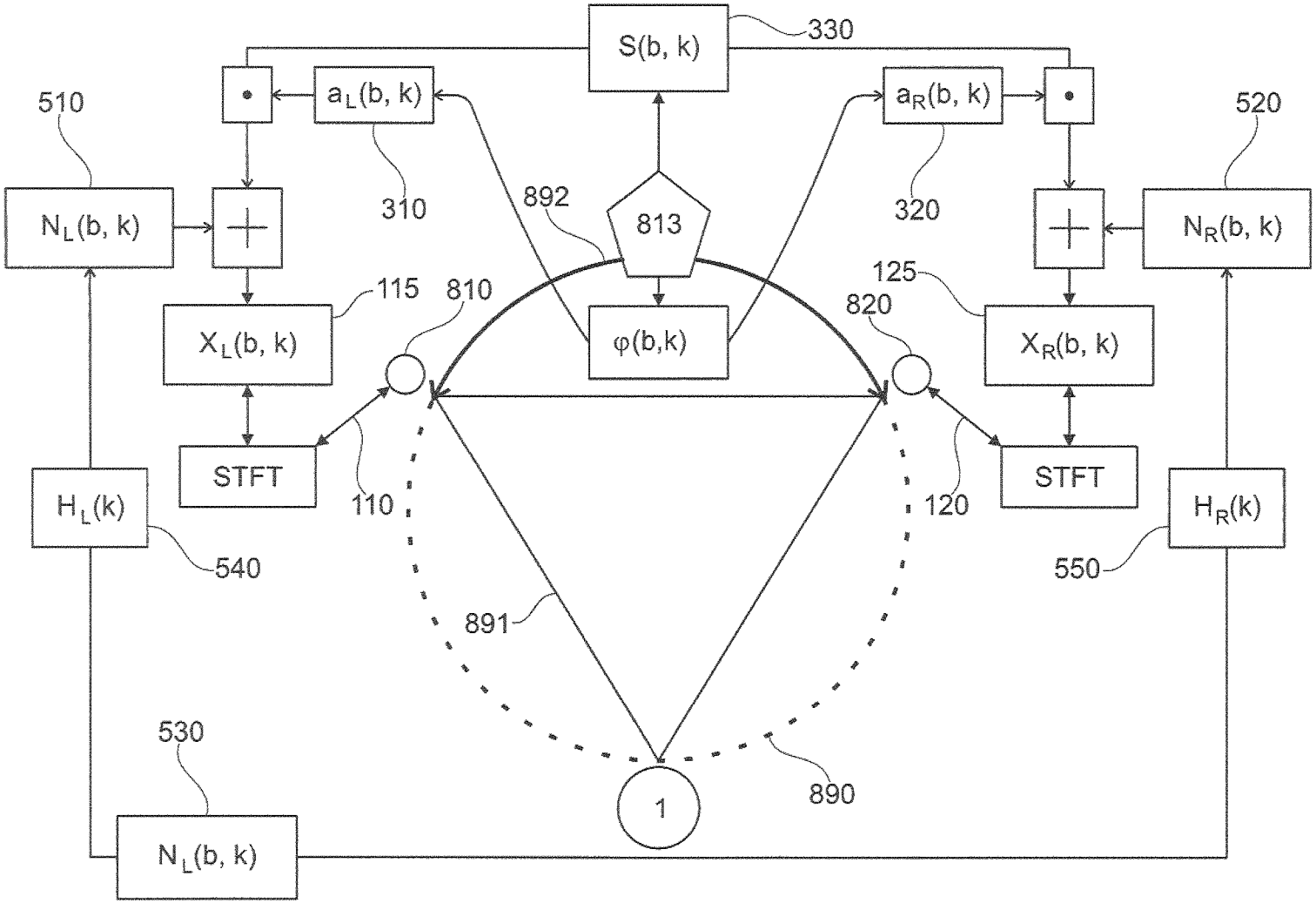

In the following, the subject matter of the invention is described by way of drawings, without the subject matter of the invention being hereby limited. In the drawings:

FIG. 1 is a schematic drawing of the simplified assumption for determining the panning coefficients, FIG. 2 shows linearisation of the azimuth position by introducing the position coefficient $\psi$, FIG. 3 shows repanning for the purpose of reproduction as a multichannel audio signal, FIG. 4 shows access to the panning coefficients by way of equations in terms of powers, and FIG. 5 shows determining the ambient signals and the direct signal from the panning coefficient by way of a further equation system.

FIG. 1 schematically illustrates the assumption which, when introduced, greatly simplifies determining the panning coefficients 310 ($a_L(b, k)$) and 320 ($a_R(b, k)$). In the time-frequency representation, time is basically indicated in the following as a block number b of the block obtained in the short-time Fourier transform (STFT). The frequency band or the frequency index is indicated as k.

The stereo audio signal comprises a first audio signal 110 for a left reproduction device 810 and a second audio signal 120 for a right reproduction device 820. By short-time Fourier transform (STFT), the first audio signal 110 is converted into the time-frequency representation 115 ($X_L(b, k)$) thereof. Likewise, the second audio signal 120 is converted into the time-frequency representation 125 ($X_R(b, k)$) thereof.

The listener is arranged at the position 1 at the edge of the listening region 890. The equilateral triangle defined by the listener 1, the left reproduction device 810 and the right reproduction device 820 has reference numeral 891 and is inscribed in the circular listening region 890. For determining the panning coefficients 310 and 320, according to the invention, it is now assumed that a single direct sound source 813, the volume 330 of which varies as a function of time b and frequency k, moves along the solid arc 892 at the edge of the listening region 890 in the region between the left reproduction device 810 and the right reproduction device 820. This movement is also dependent on the time b and the frequency k. The current azimuthal position φ(b, k) of the direct sound source 813 on the arc determines the panning coefficients 310 and 320. The complex amplitude 330 of the direct sound source 813, multiplicatively weighted using the first panning coefficients 310, gives the time-frequency representation 115 of the first audio signal 110. By contrast, if the signal strength 330 is multiplicatively weighted using the second panning coefficient 320, the time-frequency representation 125 of the second audio signal 120 is obtained.

FIG. 2 illustrates the relationship between the first and second panning coefficients 310 and 320 on the one hand and the position coefficient 390 (Ψ) on the other hand. The value of each of these coefficients is plotted against the azimuthal position φ from the left L through the centre M to the right R. The panning coefficients 310 and 320 progress non-linearly as a function of the azimuthal position φ. By contrast, the position coefficient 390 has the advantage that it progresses continuously linearly from the left L through the centre M to the right R.

FIG. 3 illustrates the repanning for the purpose of reproducing the stereo audio signal as a multi-channel audio signal. The signal 330 of the direct sound source, weighted using repanning coefficients 410 ($g_1$), 420 ($g_2$) and 430 ($g_3$), is converted into sound channels 580, 585 and 590, which are passed on to the three loudspeakers L, C and R. In determining the repanning coefficients 410, 420 and 430, the panning coefficients 310 and 320 determined during the analysis of the stereo signal are taken into account. On the one hand, the ambient signals 510 and 520 further determined during the analysis are additively superposed on the sound channels 580 and 590. On the other hand, they are passed on to additional loudspeakers RL and RR. All loudspeakers, L, C, R, RL and RR are arranged on a circle K, which simultaneously defines the listening region 890 around the listener 1. The angular positions of the loudspeakers L, C and R are positioned 30 degrees apart from one another in each case. The angular positions of the loudspeakers RL and C or RR and C are positioned 115 degrees apart from one another in each case.

FIG. 4 schematically illustrates the alternative access to the panning coefficients 310 and 320 by way of equations in terms of powers. In this example, the two audio signals 110 and 120 are each decomposed in the time domain using a filter bank 150. The filter bank 150 shown by way of example in FIG. 4 contains four band-pass filters, identified by band indices k=1, k=2, k=3 and k=4. The filter having band index k=1 only allows frequencies w for which $0<\omega\leq\omega_1$ to pass through. The filter having band index k=2 only allows frequencies w for which $\omega_1<\omega\leq\omega_2$ to pass through. The filter having band index k=3 only allows frequencies ωfor which $\omega_2<\omega\leq\omega_3$ to pass through. Finally, the filter having band index k=4 only allows frequencies ω for which $\omega_3<\omega\leq\omega_4$ to pass through.

The output signal of each filter is still a time-dependent signal. The frequency information is present in the information as to the filter from which the signal comes, in other words as to the band index k to which it belongs. All of the output signals $x_{L,R}$(b, k=1-4) thus together form time-frequency representations 115 or 125 of the audio signals 110 and 120 respectively. In step 145, from each the output signals $x_{L,R}$(b, k=1-4), the associated instantaneous power $P_{L,R}$(b, k=1-4) is determined by recursive averaging in each case. These functions together form the time- and frequency-dependent power $P_{L,R}$(b, k), denoted by reference numerals 115*a* and 125*a* respectively, of the left audio signal 110 and the right audio signal 120. This power is on the left side of the equation.

On the right side of the equation is the product of the square of the panning coefficient $a_{L,R}$(b, k) denoted by reference numeral 310 or 320 with the power $P_S$(b, k) (reference numeral 330*a*) of the sought direct signal s(b, k) (reference numeral 330).

FIG. 5 is based on FIG. 1, and schematically illustrates how in the next step the direct signal 330 (S(b, k)) and the two ambient signals 510 ($N_L$(b, k)) and 520 ($N_R$(b, k)) can be determined from the panning coefficients 310 ($a_L$(b, k)) and 320 ($a_R$(b, k)). The time-frequency representation 115 ($X_L$(b, k)) of the first audio signal 110 is derived unambiguously from the sought first ambient signal 510, the likewise sought direct signal 330 and the known first panning coefficient 310 using a first equation. Likewise, the time-frequency representation 125 ($X_R$(b, k)) of the second audio signal 120 is derived unambiguously from the sought second ambient signal 520, the sought direct signal 330 and the known second panning coefficient 320 using a second equation. These two equations contain three unknown variables. To obtain a unique solution, one of the unknowns is eliminated.

For this purpose, the fact that the two ambient signals 510 and 520 sound similar is exploited. It is therefore assumed that they are attributable to the same shared ambient signal 530 (N(b, k)), which has been filtered merely using two different decorrelation functions 540 ($H_L$(k)) and 550 ($H_R$(k)). The decorrelation functions 540 and 550 are not known, but in accordance with the prior art can be represented for example as filter functions having a random frequency characteristic. This approximation is sufficient to be able to solve the two equations for the direct signal 330 and the shared ambient signal 530.

In the following, an embodiment of the method according to the invention is explained mathematically.

The processing is based on a signal model which describes the first audio signal 110 ($x_L$(n)) for the left reproduction device 810 and second audio signal 120 ($x_R$(n)) for the right reproduction device 820

$$x_L(n) = \left[\sum_{j=1}^{J} a_{L,j} \cdot s_j(n)\right] + n_L(n) = a_{L,1} \cdot s_1(n) + a_{L,2} \cdot s_2(n) + \ldots + n_L(n) \tag{1}$$

$$x_R(n) = \left[\sum_{j=1}^{J} a_{R,j} \cdot s_j(n)\right] + n_R(n) = a_{R,1} \cdot s_1(n) + a_{R,2} \cdot s_2(n) + \ldots + n_R(n) \tag{2}$$

contained in a stereo audio signal and recorded at discrete times n, as the weighted sum of individual source signals $s_j$(n), where j=1, J indicates the individual sound sources. The left channel $x_L$ and the right channel $x_R$ further contain the diffuse ambient signals $n_L$(n) and $n_R$(n) respectively, neither of which is direction-dependent. The panning coefficients $a_{L,j}$ and $a_{R,j}$ each specify a direction-dependent weighting, by means of which the source signals $s_j$(n), which are merely time-dependent, are taken into account in the first audio signal $x_L$ and in the second audio signal $x_R$.

The panning coefficients $a_{L,j}$ and $a_{R,j}$ can be linked to one another using the relationship $a_{L,j}^2+a_{L,j}^2=1$, with the result that a constant loudness is achieved independently of the position of the individual sources. This corresponds to the constant power panning usually used in music production.

The signals can now be converted into a time-frequency representation in various ways. For example, a short-time Fourier transform (STFT) may be carried out. However, a time-frequency representation can also be obtained directly from the time-dependent signals. For example, the signals can be decomposed, using a filter bank consisting of a plurality of band-pass filters connected in parallel, into components let through by each of these band-pass filters. Each of these components is subsequently still a time-dependent signal. Irrespective of how the time-frequency representation has been obtained, it can be written as $$X_L(b,k)=\sum_{j=1}^{J} a_{L,j}\cdot S_j(b,k)+N_L(b,k) \tag{3}$$

$$X_R(b,k)=\sum_{j=1}^{J} a_{R,j}\cdot S_j(b,k)+N_R(b,k) \tag{4}$$

If the time-frequency representation has been obtained by short-time Fourier transform (STFT), b is usually referred to as the block index and k as the frequency index. By contrast, if the time-frequency representation has been obtained directly from the time-dependent signals, for example using a filter bank, b is usually referred to as the time index and k as the band index, since the discretisation of the frequencies is determined by the frequency bands let through by each of the band-pass filters.

The coefficients $a_{R,j}$ and $a_{L,j}$ can further be combined into a position coefficient $$\Psi_j=a_{R,j}^2-a_{L,j}^2 \tag{5}$$

This is in a linear relationship with the azimuthal position, the range of values of [−1, . . . , 1] being mapped to signals panned as far as possible to the left and right (FIG. 2). This makes possible an intuitive assignment between the value of the coefficient and the actual position in the stereo panorama.

If the powers $P_L(b, k)$ and $P_R(b, k)$ are compared with one another instead of the amplitudes $X_L(b, k)$ and $X_R(b, k)$, it is more expedient to write the position coefficient as $$\Psi_j=\frac{a_{R_j}-a_{L_j}}{a_{R_j}+a_{L_j}} \tag{5a}$$

It is thus still in the linear relationship shown in FIG. 2 with the azimuthal position.

Under the assumption that in equations (3) and (4) only one dominant source occurs in a frequency band k, the individual sources $S_j(b, k)$ can be combined into a single, unpanned mixed source (direct sound source) having a time- and frequency-dependent complex amplitude $S(b, k)=\Sigma S_j(b, k)$. The effect of this mixed source on the signals $X_L(b, k)$ and $X_R(b, k)$ is thus likewise time- and frequency-dependent, and is described by the panning coefficients $a_L(b, k)$ and $a_R(b, k)$:

$$X_L(b,k)=a_L(b,k)\cdot S(b,k)+N_L(b,k) \tag{3a}$$

$$X_R=a_R(b,k)\cdot S(b,k)N_R(b,k) \tag{4a}$$

Neglecting the diffuse ambient signals $N_L$ and $N_R$, which are usually relatively small by comparison with S, results overall in the following equation system for the panning coefficients $a_L(b, k)$ and $a_R(b, k)$:

$$a_L^2(b,k)+a_R^2(b,k)=1 \tag{6}$$

$$X_L(b,k)=a_L(b,k)\cdot S(b,k) \tag{7}$$

$$X_R(b,k)=a_R(b,k)\cdot S(b,k) \tag{8}$$

By solving, the panning coefficients $$a_L(b,k)=\sqrt{\frac{X_L(b,k)^2}{X_L(b,k)^2+X_R(b,k)^2}} \tag{9}$$

$$a_R(b,k)=\sqrt{\frac{X_R(b,k)^2}{X_L(b,k)^2+X_R(b,k)^2}} \tag{10}$$

are obtained. The signals $X_L$, $X_R$ and S are in general complex-valued, whilst the panning coefficients $a_L$ and $a_R$ are real-valued, since in the signal model according to equations (7) and (8) pure amplitude panning is carried out, in other words only the amplitude is direction-dependent. As a result, both $X_L(b, k)$ and $X_R(b, k)$ are in phase with S(b, k). Thus, in the polar representations $$a_L(b,k)=\sqrt{\frac{|X_L(b,k)|^2\cdot\exp(-2i\varphi_L)}{|X_R(b,k)|^2\cdot\exp(-2i\varphi_R)+|X_L(b,k)|^2\cdot\exp(-2i\varphi_L)}} \tag{11}$$

$$a_R(b,k)=\sqrt{\frac{|X_R(b,k)|^2\cdot\exp(-2i\varphi_R)}{|X_R(b,k)|^2\cdot\exp(-2i\varphi_R)+|X_L(b,k)|^2\cdot\exp(-2i\varphi_L)}} \tag{12}$$

the phases $\phi_L$ of $X_L$, $\phi_R$ of $X_R$ and $\phi_S$ of S are identical, in such a way that the phase terms can be cancelled out:

$$a_L(b,k)=\sqrt{\frac{|X_L(b,k)|^2}{|X_R(b,k)|^2+|X_L(b,k)|^2}} \tag{13}$$

$$a_R(b,k)=\sqrt{\frac{|X_R(b,k)|^2}{|X_R(b,k)|^2+|X_L(b,k)|^2}} \tag{14}$$

In this approximation, the panning coefficients $a_L$ and $a_R$ are thus directly linked to the power density spectra (time-frequency representations) $X_L$ and $X_R$ of the first and second audio signal, which together result in the stereo audio signal.

Alternatively, depending on the requirements and the application, the position coefficient $$\Psi(b,k)=\frac{|X_R(b,k)|^2-|X_L(b,k)|^2}{|X_R(b,k)|^2+|X_L(b,k)|^2} \tag{15}$$

may also be calculated. This position coefficient Ψ(b, k) makes possible highly effective calculation of the position by simple consideration of the difference power spectrum and the total power of the signal.

Since in the channel model (7-8) pure amplitude panning is carried out, it follows that the left and right channel ($X_L$ and $X_R$) are in phase with the direct signal S. The channel model can thus also be expressed using the powers:

$$P_L(b,k)=a_L^2(b,k)\cdot P_S(b,k) \tag{7a}$$

$$P_R(b,k)=a_R^2(b,k)\cdot P_S(b,k). \tag{8a}$$

Herein, $P_L(b, k)$ is the power of the left channel $X_L$, $P_R(b, k)$ is the power of the right channel $X_R$, and $P_S$ is the power of the direct signal S.

If the time-frequency representation has been obtained by short-time Fourier transform (STFT), a power $P_x(b, k)$ corresponds to the power density spectrum $|X(b, k)|^2$.

By contrast, if the time-frequency representation has been obtained for example by filter bank decomposition in the time region, there is not necessarily a closed formula for the instantaneous power $P_x(b, k)$ for each band k. However, this instantaneous power can be obtained for example by recursive averaging $$P_x(b,k)=\alpha\cdot P_x(b-1,k)+(1-\alpha)\cdot[x(b,k)]^2, 0<\alpha<1 \tag{8b}$$

The lower-case letter x represents the fact that the time-frequency representation x(b, k) was obtained by decomposition in the time domain.

The square of the instantaneous signal is thus assessed as a measure for how much the instantaneous power $P_x(b, k)$ changes at time b by comparison with the previous time b−1. $\alpha$ is a weighting factor with which the adherence to the previous trend for the instantaneous power $P_x(b, k)$ is weighted against taking into account new information. It should preferably be selected sufficiently small that the average power is estimated in a stable manner, without transients or short-term signal changes resulting in major fluctuations.

By solving (7a) and (8a), the panning coefficients $$a_L(b,k)=\sqrt{\frac{P_L(b,k)}{P_L(b,k)+P_R(b,k)}} \tag{9a}$$

$$a_R(b,k)=\sqrt{\frac{P_R(b,k)}{P_L(b,k)+P_R(b,k)}}. \tag{10a}$$

are obtained. Alternatively, depending on the requirements and the application, the position coefficient $$\Psi(b,k)=\frac{P_R(b,k)-P_L(b,k)}{P_R(b,k)+P_L(b,k)} \tag{15a}$$

may also be calculated. Optionally, in this context, further adaptation to the human ear may also take place in that the powers $P_L(b, k)$ and $P_R(b, k)$ are each replaced by the root thereof in equation (15a). The position coefficient $\Psi(b, k)$ thus gives an even more realistic impression of the position of the direct sound source.

Because of the simplifying assumptions under which the panning coefficients $a_L$ and $a_R$ and the position $\Psi$ are obtained, these variables are approximate values. In the following, they are distinguished from the exact values according to the signal model using $\hat{a}_L$, $\hat{a}_R$ and $\hat{\Psi}$.

To extract the direct signal S and the ambient signals $N_L$ and $N_R$ from the sum signals $X_L$ and $X_R$ (equations (3) and (4)), an iterative method is used. From the left input channel $X_L$ and the right input channel $X_R$, direct signal contributions $\hat{S}_i$ are extracted stepwise, and are ultimately combined into the direct signal $\hat{S}$ of the direct sound source. The difference between the direct signal $\hat{S}$, weighted using the panning coefficients $a_L$ and $a_R$, and the input signals $X_L$ and $X_R$ is an approximation to the ambient signals $N_L$ and $N_R$. For improved clarity, the indices (b, k) are no longer explicitly specified in the following.

At the start of the iteration, the estimated ambient signals $\hat{N}_L$ and $\hat{N}_R$ are firstly initialised as the input signals $X_L$ and $X_R$:

$$\hat{N}_{L,0}=X_L, \hat{N}_{R,0}=X_R \tag{16}$$

Starting from this, in accordance with the iteration instructions $$\hat{a}_{L,i}=\sqrt{\frac{|\hat{N}_{L,i-1}|^2}{|\hat{N}_{R,i-1}|^2+|\hat{N}_{L,i-1}|^2}} \tag{17}$$

$$\hat{a}_{R,i}=\sqrt{\frac{|\hat{N}_{R,i-1}|^2}{|\hat{N}_{R,i-1}|^2+|\hat{N}_{L,i-1}|^2}} \tag{18}$$

$$\hat{S}_i=\frac{(\hat{N}_{L,i-1}+\hat{N}_{R,i-1})}{2} \tag{19}$$

the panning coefficients are refined and a direct signal contribution is calculated. In the first iteration, the panning coefficients have exactly the values according to equations (13) and (14) as starting values. The direct signal contribution $\hat{S}_i$ is calculated according to equation (19) under the assumption that the direct signal is present in the same phase in the first and the second audio signal and the ambient signals are phase-shifted therefrom.

Before the next iteration, the ambient signals are self-consistently updated using $$\hat{N}_{L,i}=\hat{N}_{L,i-1}-\hat{a}_{L,i}\cdot\hat{S}_i \tag{20}$$

$$\hat{N}_{R,j}=\hat{N}_{R,i-1}-\hat{a}_{R,i}\cdot\hat{S}_i \tag{21},$$

"self-consistently" meaning that a signal component which has been found to be a direct signal component correlated with the direct sound source 813 cannot at the same time belong to the diffuse ambient signal. This self-consistent solution is distinguished in particular in that it makes possible good extraction of highly panned, in other words highly direction-dependent, direct signals.

After all I iterations are complete, this results in the overall direct signal, correlated with the direct sound source 813, as the sum of the individual signal components $\hat{S}_i$:

$$\hat{S}=\sum_{i=1}^{I}\hat{S}_i. \tag{22}$$

In determining the panning coefficients $a_{L,i}$ and $a_{R,I}$ and the signal components $\hat{S}_i$, only self-consistency with the ambient signals $\hat{N}_{L,i}$ and $\hat{N}_{R,i}$ was required, without the signal model according to equations (3) and (4) having been drawn on. Therefore, it is not ensured that the ultimately obtained values of $\hat{N}_L$, $\hat{N}_R$ and $\hat{S}$ adhere to this signal model. Since infraction of the signal model has a greater effect on the listening impression than a deviation in the diffuse ambient signal, fulfilling the signal model is accorded priority over approximating $\hat{N}_L$ and $\hat{N}_R$ as exactly as possible. Therefore, the values $\hat{N}_{L,I}$ and $\hat{N}_{R,I}$ obtained in the final iteration are not used as the ambient signals $\hat{N}_L$ and $\hat{N}_R$, which are instead calculated at the end from the overall result $\hat{S}$ for the direct signal and the first approximation values $\hat{a}_{L,1}$ and $\hat{a}_{R,1}$ for the panning coefficients:

$$\hat{N}_L = X_L - \hat{a}_{L,1} \cdot \hat{S} \tag{23}$$

$$\hat{N}_R = X_R - \hat{a}_{R,1} \cdot \hat{S} \tag{24}$$

The panning coefficients refined during the iterative method in accordance with equations (17) and (18) are used exclusively for splitting the signals $X_L$ and $X_R$ into the direct signal $\hat{S}$ and ambient signals $\hat{N}_L$ and $\hat{N}_R$. For repanning to a configuration of more than two loudspeakers, the panning coefficients obtained from the solution to the equation system (13-14) are still used.

As $i \to \infty$, in accordance with equations (20) and (21) it holds for the ambient signals $\hat{N}_{L,i}$ and $\hat{N}_{R,i}$ that $$\hat{N}_{L,i} = -\hat{N}_{R,i} \tag{25}$$

Thus, the two ambient signals are identical except for phase rotation. The original signal model according to equations (3a) and (4a) thus simplifies to $$X_L = a_L \cdot S + N \tag{26}$$

$$X_R = a_R \cdot S - N \tag{27}$$

Plugging in the panning coefficients according to equations (13) and (14) and solving gives $$\hat{S} = \frac{X_L + X_R}{\hat{a}_L + \hat{a}_R} \tag{28}$$

$$\hat{N} = \frac{\hat{a} \cdot X_L - \hat{a}_L \cdot X_R}{\hat{a}_L + \hat{a}_R}$$

as approximate values for the direct signal S and the ambient signal $$\hat{N}_L \equiv -\hat{N}_R \equiv \hat{N}.$$

In the following, a more general approach for determining the direct signal and the ambient panning coefficients is given. This approach is based on the assumption that the two ambient signals sound similar, but are decorrelated as a result of different propagation paths and reflections.

Thus, the two ambient signals $\hat{N}_L$ and $\hat{N}_R$ can be represented as filterings of a shared ambient signal N having different decorrelation functions $H_L$ and $H_R$:

$$\hat{N}_L(b,k) = H_L\{N(b,k)\}, \tag{29}$$

$$\hat{N}_R(b,k) = H_R\{N(b,k)\}. \tag{30}$$

Filtering can be expressed in a time-frequency representation as band-wise multiplication by an amplification factor and by a phase rotation. $X_L(b, k)$ and $X_R(b, k)$ are thus linked to the direct signal S and the ambient signal N by the two equations $$X_L(b,k) = a_L(b,k) \cdot S(b,k) + H_L(b,k) \cdot N(b,k) \tag{31}$$

$$X_R(b,k) = a_R(b,k) \cdot S(b,k) + H_R(b,k) \cdot N(b,k) \tag{32}$$

This general form of the decorrelation functions $H_{L,R}(b, k)$ can, if the time-frequency representations $X_L(b, k)$ and $X_R(b, k)$ have been obtained from a complete transformation into the frequency domain, for example by short-time Fourier transformation (STFT), be described as a complex spectrum $$H_{L,R}(k) = \gamma(k) \cdot \exp(i\phi(k)), 0 < \gamma(k) < 1, 0 < \phi(k) < \pi \tag{33}$$

having a frequency-dependent amplitude $\gamma(k)$ and phase $\phi(k)$.

Plugging the panning coefficients from equations (9) and (10) into equations (31) and (32) and solving gives $$\hat{S}(b,k) = \frac{X_L(b,k) \cdot H_R(k) - X_R(b,k) \cdot H_L(k)}{\hat{a}_L(b,k) \cdot H_R(k) - \hat{a}_R(b,k) \cdot H_L(k)}, \tag{34}$$

$$\hat{N}(b,k) = \frac{\hat{a}_L(b,k) \cdot X_R(k) - \hat{a}_R(b,k) \cdot X_L(b,k)}{\hat{a}_L(b,k) \cdot H_R(k) - \hat{a}_R(b,k) \cdot H_L(k)} \tag{35}$$

for the estimated direct signal $\hat{S}$and for the shared ambient signal $\hat{N}$.

If time-frequency representations $x_L(b, k)$ and $x_R(b, k)$ are obtained using a filter bank, equations (31) and (32) become $$X_L(b,k) = a_L(b,k) \cdot s(b,k) + h_L\{n(b,k)\} \tag{36}$$

$$x_R(b,k) = a_R(b,k) \cdot s(b,k) + h_R\{n(b,k)\}, \tag{37}$$

where the naming of h, x, a, s and n using lower-case letters again clarifies that these are variables in the time domain. The decorrelation functions $H_L$ and $H_R$ can now no longer be applied as simply as in the frequency domain. With the limitation $$h_{L,R}(k) = \gamma(k) \cdot (\pm 1), \tag{38}$$

according to which the decorrelation function can only generate phase shifts of 0 (+1) and $\pi$ (−1) for each band, equations (36) and (37) simplify to $$X_L(b,k) = a_L(b,k) \cdot s(b,k) + h_L(k) \cdot n(b,k) \tag{39}$$

$$x_R(b,k) = a_R(b,k) \cdot s(b,k) + h_R(k) \cdot n(b,k). \tag{40}$$

Mathematical rearrangement gives $$\hat{s}(b,k) = \frac{h_R(k) \cdot x_L(b,k) - h_L(k) \cdot x_R(b,k)}{h_R(k) \cdot \hat{a}_L(b,k) - h_L(k) \cdot \hat{a}_R(b,k)}, \tag{41}$$

$$\hat{n}(b,k) = \frac{\hat{a}_L(b,k) \cdot x_R(k) - \hat{a}_R(b,k) \cdot x_L(b,k)}{\hat{a}_L(b,k) \cdot h_R(k) - \hat{a}_R(b,k) \cdot h_L(k)} \tag{42}$$

as the solutions for the direct and ambient signals.

LIST OF REFERENCE NUMERALS

1 Position of the listener
110 First (left) audio signal $x_L$ of the stereo audio signal
115 Time-frequency representation $X_L$ of the first audio signal 110
115*a* Time- and frequency-dependent power $P_L$ of the signal 110
120 Second (right) audio signal $x_R$ of the stereo audio signal
125 Time-frequency representation $X_R$ of the second audio signal 120
125*a* Time- and frequency-dependent power $P_R$ of the signal 120
145 Determining the time- and frequency-dependent power 115*a*, 125*a*
150 Filter bank
310 Panning coefficients $a_L(b, k)$ of the first audio signal 110
320 Panning coefficients $a_R(b, k)$ of the second audio signal 120
330 Complex amplitude S(b, k) of the direct sound source 813
330*a* Time- and frequency-dependent power $P_S$ of the signal 330
φ Azimuthal position of the direct sound source 813
390 Position coefficient Ψ
410 First repanning coefficient $g_1$ for first sound channel 580

420 Second repanning coefficient $g_2$ for second sound channel 585
430 Third repanning coefficient $g_3$ for third sound channel 590
510 First (left) ambient signal $N_L$
520 Second (right) ambient signal $N_R$
530 Shared ambient signal N(b, k)
540 First decorrelation function $H_L(k)$
550 Second decorrelation function $H_R(k)$
580 First sound channel for loudspeaker at position L (left)
585 Second sound channel for loudspeaker at position C (centre)
590 Third sound channel for loudspeaker at position R (right)
810 Left reproduction device for the first audio signal 110
813 Direct sound source
820 Right reproduction device for the second audio signal 120
890 Listening region in front of the listener 1 or around the listener 1
891 Equilateral triangle in the listening region 890
892 Arc at the edge of the listening region 890
L, C, R Loudspeaker positions left, centre, right for the repanning
RL, RR Additional loudspeaker positions for ambient signals 510, 520.

The invention claimed is:

1. A method for analysing a stereo audio signal, the stereo audio signal comprising a first audio signal for a left reproduction device and a second audio signal for a right reproduction device, comprising the following steps:

the first audio signal is converted into a first time-frequency representation, and the second audio signal is converted into a second time-frequency representation;

the time- and frequency-dependent power of the first audio signal is determined from the first time-frequency representation, and the time- and frequency-dependent power of the second audio signal is determined from the second time-frequency representation;

a first equation is established relating the time- and frequency-dependent power of the first audio signal to the product of the square of a first time- and frequency-dependent panning coefficient with the time- and frequency-dependent power of a direct sound source arranged in a listening region between the left reproduction device and the right reproduction device;

a second equation is established relating the time- and frequency-dependent power of the second audio signal to the product of the square of a second time- and frequency-dependent panning coefficient with the same time- and frequency-dependent power of the same direct sound source;

the first and second panning coefficients being configured to position the direct sound source in the listening region;

the first and second panning coefficients and/or a position coefficient, which corresponds to the ratio of a difference between the first and second panning coefficients to the sum of the first and second panning coefficients, are determined as solutions to the equation system formed from the first and second equations; wherein the equation system is solved under the additional condition that the sum of the squares of the first and second panning coefficients is constant; and wherein the first panning coefficient is determined as the root of the ratio of the time- and frequency-dependent power of the first audio signal to the sum of the time- and frequency-dependent powers of the first and second audio signals, and in that the second panning coefficient is determined as the root of the ratio of the time- and frequency-dependent power of the second audio signal to the sum of the time- and frequency-dependent powers of the first and second audio signals.

2. A method for analysing a stereo audio signal, the stereo audio signal comprising a first audio signal for a left reproduction device and a second audio signal for a right reproduction device, comprising the following steps:

the first audio signal is converted into a first time-frequency representation, and the second audio signal is converted into a second time-frequency representation;

the time- and frequency-dependent power of the first audio signal is determined from the first time-frequency representation, and the time- and frequency-dependent power of the second audio signal is determined from the second time-frequency representation;

a first equation is established relating the time- and frequency-dependent power of the first audio signal to the product of the square of a first time- and frequency-dependent panning coefficient with the time- and frequency-dependent power of a direct sound source arranged in a listening region between the left reproduction device and the right reproduction device:

a second equation is established relating the time- and frequency-dependent power of the second audio signal to the product of the square of a second time- and frequency-dependent panning coefficient with the same time- and frequency-dependent power of the same direct sound source;

the first and second panning coefficients being configured to position the direct sound source in the listening region;

the first and second panning coefficients and/or a position coefficient, which corresponds to the ratio of a difference between the first and second panning coefficients to the sum of the first and second panning coefficients, are determined as solutions to the equation system formed from the first and second equations; wherein the equation system is solved under the additional condition that the sum of the squares of the first and second panning coefficients is constant and wherein the position coefficient is determined from the ratio of the difference between the roots of the time and frequency-dependent powers of the first and second audio signals to the sum of the roots of the time- and frequency-dependent powers of the first and second audio signals.

3. The method according to claim 1, wherein the time- and frequency-dependent power of at least one of the first and second audio signals at a time of interest is determined as a weighted sum of the time- and frequency-dependent power of the at least one of the first and second audio signals at an earlier time and the square of the time-frequency representation of the at least one of the first and second audio signals at the time of interest.

4. A method for analysing a stereo audio signal, the stereo audio signal comprising a first audio signal for a left reproduction device and a second audio signal for a right reproduction device, comprising the following steps:

the first audio signal is converted into a first time-frequency representation, and the second audio signal is converted into a second time-frequency representation;

a first equation is established relating the first time-frequency representation to the product of a first time- and frequency-dependent panning coefficient with the time- and frequency-dependent signal of a direct sound source arranged in a listening region between the left reproduction device and the right reproduction device;

a second equation is established relating the second time-frequency representation to the product of a second time- and frequency-dependent panning coefficient with the same signal of the direct sound source;

the first and second panning coefficients being configured so as to position the direct sound source in the listening region;

the first and second panning coefficients and/or a position coefficient, which corresponds to the difference between the squares of the first and second panning coefficients, are determined as solutions to the equation system formed from the first and second equations, wherein the equation system is solved under the additional condition that the sum of the squares of the first and second panning coefficients is constant, and wherein the first panning coefficient is determined as the root of the ratio of the square of the time-frequency representation of the first audio signal to the sum of the squares of the time-frequency representations of the first and second audio signals , and in that the second panning coefficient is determined as the root of the ratio of the square of the time-frequency representation of the second audio signal to the sum of the squares of the time-frequency representations of the first and second audio signals.

5. A method for analysing a stereo audio signal, the stereo audio signal comprising a first audio signal for a left reproduction device and a second audio signal for a right reproduction device, comprising the following steps:

the first audio signal is converted into a first time-frequency representation, and the second audio signal is converted into a second time-frequency representation;

a first equation is established relating the first time-frequency representation to the product of a first time- and frequency-dependent panning coefficient with the time- and frequency-dependent signal of a direct sound source arranged in a listening region between the left reproduction device and the right reproduction device;

a second equation is established relating the second time-frequency representation to the product of a second time- and frequency-dependent panning coefficient with the same signal of the direct sound source;

the first and second panning coefficients being configured so as to position the direct sound source in the listening region;

the first and second panning coefficients and/or a position coefficient, which corresponds to the difference between the squares of the first and second panning coefficients, are determined as solutions to the equation system formed from the first and second equations, wherein the equation system is solved under the additional condition that the sum of the squares of the first and second panning coefficients is constant; and wherein the position coefficient is determined from the ratio of the difference between the squares of the magnitudes of the first and second time-frequency representations to the sum of the squares of the magnitudes of the first and second time-frequency representations.

6. The method according to claim 1, wherein the signal of the direct sound source and/or first and second ambient signals not correlated with this direct sound source are determined from the first and second panning coefficients, the first ambient signal being contained in the time-frequency representation of the first audio signal and the second ambient signal being contained in the time-frequency representation of the second audio signal.

7. A method for analysing a stereo audio signal, the stereo audio signal comprising a first audio signal for a left reproduction device and a second audio signal for a right reproduction device, comprising the following steps:

the first audio signal is converted into a first time-frequency representation, and the second audio signal is converted into a second time-frequency representation;

the time- and frequency-dependent power of the first audio signal is determined from the first time-frequency representation, and the time- and frequency-dependent power of the second audio signal is determined from the second time-frequency representation;

a first equation is established relating the time- and frequency-dependent power of the first audio signal to the product of the square of a first time- and frequency-dependent panning coefficient with the time- and frequency-dependent power of a direct sound source arranged in a listening region between the left reproduction device and the right reproduction device;

a second equation is established relating the time- and frequency-dependent power of the second audio signal to the product of the square of a second time- and frequency-dependent panning coefficient with the same time- and frequency-dependent power of the same direct sound source;

the first and second panning coefficients being configured to position the direct sound source in the listening region;

the first and second panning coefficients and/or a position coefficient, which corresponds to the ratio of a difference between the first and second panning coefficients to the sum of the first and second panning coefficients, are determined as solutions to the equation system formed from the first and second equations, wherein the signal of the direct sound source and/or first and second ambient signals not correlated with this direct sound source are determined from the first and second panning coefficients, the first ambient signal being contained in the time-frequency representation of the first audio signal and the second ambient signal being contained in the time-frequency representation of the second audio signal a first equation is established which relates the first time-frequency representation to the sum of the product of the first panning coefficient with the time- and frequency-dependent signal of the direct sound source and the filtering of a single shared ambient signal using a first decorrelation function;

a second equation is established which relates the second time-frequency representation to the sum of the product of the second panning coefficient with the time- and frequency-dependent signal of the direct sound source and the filtering of the shared ambient signal using a second decorrelation function;

the time- and frequency-dependent signal of the direct sound source and/or the shared ambient signal are determined as solutions to the equation system formed from the first and second equations.

8. The method according to claim 7, wherein the time- and frequency-dependent signal of the direct sound source is determined as the difference between the frequency-band-wise product of the first time-frequency representation with the second decorrelation function and the frequency-band-wise product of the second time-frequency representation with the first decorrelation function, divided by the difference between the convolution of the first panning coefficient with the second decorrelation function and the frequency-band-wise product of the second panning coefficient with the first decorrelation function.

9. The method according to claim 7, wherein the shared ambient signal is determined as the difference between the product of the second time-frequency representation with the first panning coefficient and the product of the first time-frequency representation with the second panning coefficient, divided by the difference between the frequency-band-wise product of the first panning coefficient with the second decorrelation function and the frequency-band-wise product of the second panning coefficient with the first decorrelation function.

10. The method according to claim 6, wherein the signal of the direct sound source and the first and second ambient signals are determined by an iterative method, on the basis of an iteration instruction which relates the signal of the direct sound source of each iteration, or a contribution to the signal of the direct sound source of each iteration, to the first and second ambient signals of the previous iteration.

11. The method according to claim 10, wherein at each iteration the first and second panning coefficients are recalculated from the first and second ambient signals of the previous iteration.

12. The method according to claim 11, wherein the first ambient signal is corrected at each iteration by an amount equal to the product of the recalculated first panning coefficient with the signal of the direct sound source according to the current iteration, and in that the second ambient signal is corrected at each iteration by an amount equal to the product of the recalculated second panning coefficient with the signal of the direct sound source according to the current iteration.

13. The method according to claim 6, wherein the signal of the direct sound source is determined from the ratio of the sum of the first and second time-frequency representations and to the sum of the first and second panning coefficients.

14. The method according to claim 6, wherein the ambient signals are determined from the ratio of a difference between the time-frequency representation of the first audio signal, weighted using the second panning coefficient, and the time-frequency representation of the second audio signal, weighted using the first panning coefficient, to the sum of the first and second panning coefficients.

15. A method for generating a multichannel audio signal from a stereo audio signal, the stereo audio signal having a first audio signal for a left reproduction device and a second audio signal for a right reproduction device, comprising the following steps:

the stereo audio signal is analysed and decomposed by a method according to claim 1;

a plurality of repanning coefficients are determined from the first and second panning coefficients, each of these repanning coefficients being assigned to one sound channel of a plurality of sound channels of the multichannel audio signal, and the repanning coefficients for the plurality of sound channels being configured to position a direct sound source in a listening region between a plurality of reproduction devices for the multichannel audio signal;

the signal of the direct sound source has the first repanning coefficient applied and is assigned to a first sound channel;

the signal of the direct sound source has a second repanning coefficient applied and is assigned to a second sound channel;

the signal of the direct sound source has a third repanning coefficient applied and is assigned to a third sound channel.

16. The method according to claim 15, wherein the first ambient signal is added to the first sound channel and the second ambient signal is added to the third sound channel.

17. The method according to claim 15, wherein each sound channel is converted into an associated reproduction signal of the multichannel audio signal, each reproduction signal being provided for an associated reproduction device.

* * * * *